US006948801B2

(12) United States Patent
Rehman et al.

(10) Patent No.: US 6,948,801 B2
(45) Date of Patent: Sep. 27, 2005

(54) FLUID INTERCONNECT WITH SEALANT

(75) Inventors: Zia Rehman, Corvallis, OR (US); John L. Taylor, Corvallis, OR (US); Raymond J. Adamic, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 443 days.

(21) Appl. No.: 10/117,648

(22) Filed: Apr. 4, 2002

(65) Prior Publication Data

US 2003/0189624 A1 Oct. 9, 2003

(51) Int. Cl.[7] ..... B41J 2/175

(52) U.S. Cl. ..... 347/85

(58) Field of Search ..... 347/65, 84, 85, 347/87; 277/29; 166/277; 604/256, 283

(56) References Cited

U.S. PATENT DOCUMENTS

| | | | | | |
|---|---|---|---|---|---|
| 3,693,985 | A | * | 9/1972 | Dillner | 277/29 |
| 5,117,909 | A | * | 6/1992 | Wilton et al. | 166/277 |
| 5,774,152 | A | * | 6/1998 | Namba et al. | 347/65 |
| 5,796,419 | A | * | 8/1998 | Clark et al. | 347/85 |
| 6,488,368 | B2 | * | 12/2002 | Petersen et al. | 347/85 |
| 6,511,165 | B1 | * | 1/2003 | Barinaga et al. | 347/85 |

FOREIGN PATENT DOCUMENTS

| | | | | |
|---|---|---|---|---|
| JP | 10249996 | * | 9/1998 | B32B/15/08 |

* cited by examiner

*Primary Examiner*—Anh T. N. Vo

(57) ABSTRACT

A fluid interconnect for a component of a printer is disclosed. The component may, for example, be an inkjet printhead removably attached to a printer and having an ink inlet configured to receive ink from an ink supply. The fluid interconnect has a sealing surface configured to form a seal when contacted against a opposing sealing surface on another component of a printer ink delivery system, and carries a surfactant sealant.

36 Claims, 2 Drawing Sheets

FLUID INTERCONNECT WITH SEALANT

TECHNICAL FIELD

The present invention relates to a fluid interconnect for a printer. More particularly, the invention concerns a fluid interconnect configured to form an air-resistant seal in an ink delivery system of a printer. The invention also concerns a method of protecting ink in a printer from vapor loss and air contamination during transfer of the ink from an ink supply to a printhead.

BACKGROUND OF THE INVENTION

In contrast to other types of printers, inkjet printers provide fast, high resolution, black-and-white and color printing on a wide variety of media, and at a relatively low cost. As a result, inkjet printers have become one of the most popular types of printers for both consumer and business applications. Inkjet printers deposit ink onto a sheet of media by ejecting tiny drops of ink from a printhead. The inkjet printhead includes a plurality of ink ejection mechanisms, essentially tiny nozzles, that are formed on a substrate. The substrate is connected to an ink supply to deliver ink to the ejection mechanisms. Each ink ejection mechanism includes a firing chamber with at least one ejection orifice and one or more firing resistors located in the firing chamber. Control circuitry, located on the substrate and/or remote from the substrate, supplies current to the firing resistors in selected firing chambers. The ink within the selected chambers is super-heated by the firing resistors, causing the ink in close proximity to the resistors to be vaporized. This forms a bubble that pushes ink through the chamber orifice toward the printing medium in the form of an ink droplet.

Due to the many processing steps required to create the various printhead structures on the substrate, the printhead is typically one of the most expensive parts of a printer. Furthermore, the cost of the printhead tends to increase with the size of the printhead. For smaller printers, the cost of the printhead may be low enough to allow use of an integrated ink supply system in which the printhead is permanently attached to the ink supply. Larger printers, however, often use a separate ink supply system, in which the printhead is a separate component from the ink supply. In this arrangement, the ink supply may be replaced without having to replace the printhead, thus significantly cutting the cost of new ink supplies. Nevertheless, the printhead may still require periodic replacement due to printhead failure.

One of the most common causes of printhead failure is the accumulation of excess air in the printhead. Air that accumulates in the printhead can expand with increases in temperature or altitude, causing ink to drool out of firing chambers. Air bubbles can also block small ink paths, causing the printhead to "deprime". This air may come from several possible sources. For example, because the ink supply and printhead are typically removable parts, seals may exist where these parts meet the ink delivery system. Any imperfections in these seals may allow air to enter the ink, where it may either dissolve into the ink (degassed ink is typically used in inkjet printers) or migrate to the printhead without dissolving. Air dissolved in the ink may then be evolved in the printhead due to the elevated temperatures in the printhead caused by the firing chambers.

Sealant greases may be used to coat the seals to prevent air leakage, but such greases may contaminate the ink, and thus clog the printhead. Furthermore, in the process of removing and installing printheads and ink delivery system components, a user may accidentally contaminate the ink delivery system with grease from an exposed seal. This may clog the ink ejection mechanisms of the other printhead with the sealant grease, causing the printhead to fail.

SUMMARY OF THE INVENTION

A fluid interconnect for a component of a printer is disclosed. The component may, for example, be an inkjet printhead removably attached to a printer and having an ink inlet configured to receive ink from an ink supply. The fluid interconnect has a sealing surface configured to form a seal when contacted against a opposing sealing surface on another component of a printer ink delivery system, and carries a surfactant sealant.

DETAILED DESCRIPTION OF THE PREFERRED EMBODIMENTS

Figure 1:
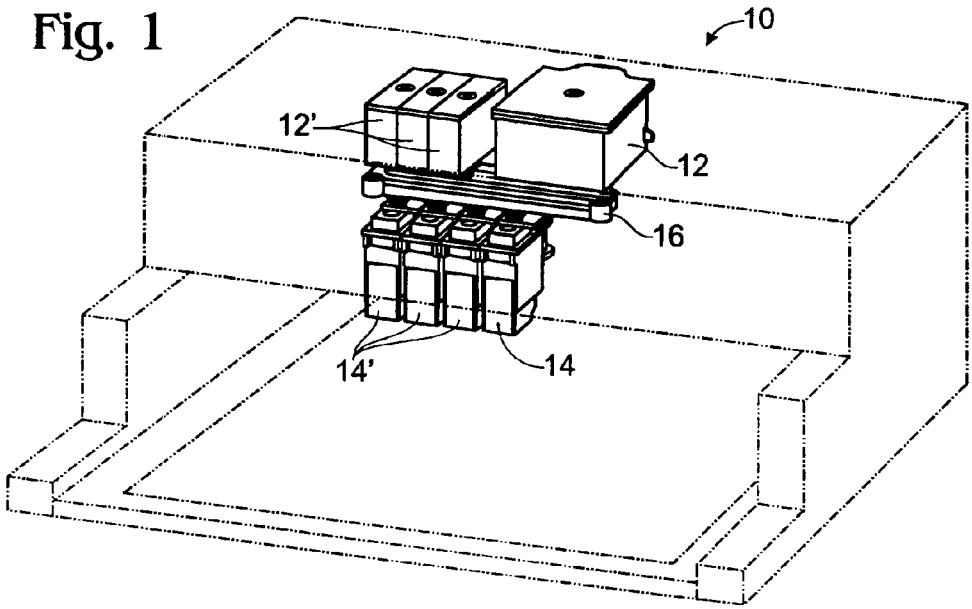
FIG. 1 is an isometric view of a desktop printer, shown generally in dashed lines, employing an ink delivery system constructed in accordance with an embodiment of the present invention.

An exemplary inkjet printer in which embodiments of the fluid interconnect of the present invention may be utilized is shown generally at 10 in FIG. 1 as a desktop printer having at least one ink supply 12. Exemplary printer 10 also includes a printhead 14 for depositing ink from ink supply 12 onto a sheet of media, and a suitable ink delivery system, such as an ink manifold 16 or other ink transfer structure, connecting the ink supply to the printhead. Manifold 16 is disposed between ink supply 12 and printhead 14, and transports ink from the ink supply to the printhead. Although described with respect to fluidically coupling a printhead to an ink supply, the fluid interconnect of the present invention may also be used to couple other printer components to the printer ink delivery system, such as, for example, coupling ink manifold 16 to the ink supply 12.

Exemplary printer 10 may have as many ink supplies and printheads as desired. In the depicted embodiment, printer 10 has four ink supplies: ink supply 12 for black ink, and three smaller ink supplies 12' for color inks. Similarly, printer 10 has four corresponding printheads: printhead 14 for printing with black ink from ink supply 12, and printheads 14' for printing with color inks from ink supplies 12'. While features of the depicted embodiment are described herein in terms of ink supply 12 or printhead 14, it will be understood that the description will also be applicable to ink supplies 12' and printheads 14', respectively. The fluid seal of the present invention may also be utilized to connect other components of the printer ink delivery system. Furthermore, while the depicted embodiment takes the form of a color desktop printer 10, it will be appreciated that a printer according to the present invention may take any other desired form, black-and-white or color, large format or small.

Figure 2:
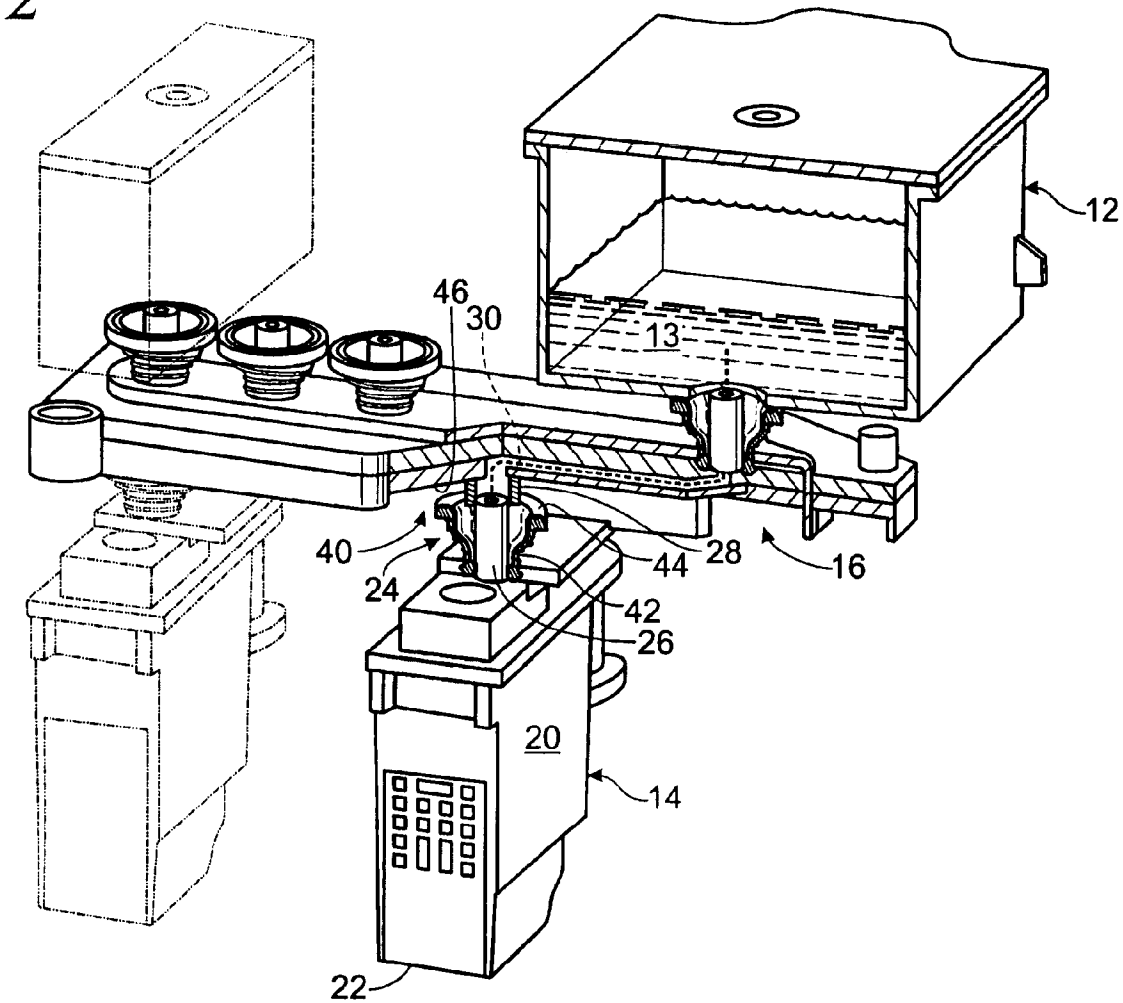
FIG. 2 is an isometric view of an ink supply and printhead connected via an ink manifold in accordance with an embodiment of the present invention.

FIG. 2 shows ink supply 12, printhead 14 and manifold 16 of the exemplary printer 10 in more detail. As indicated, printhead 14 is mounted to the underside of manifold 16, and includes a casing 20 extending downwardly, away from manifold 16 in a direction toward the location of a media sheet being printed. One or more ink ejection mechanisms (not shown) for ejecting ink from the printhead are disposed on the underside 22 of casing 20. Printhead 14 also includes an ink inlet 24 disposed on the top of casing 20 to accept ink 25 into casing 20 from manifold 16. While ink inlet 24 of the depicted printhead 14 is shown on the top of casing 20, it will be appreciated that the ink inlet may be positioned at any other suitable location on casing 20. Furthermore, while the depicted printhead 14 is configured to mount to the underside of manifold 16, it may also be configured to mount to the side or top of manifold 16. Finally, it will be appreciated that the shape and relative size of the depicted printhead 14 is merely exemplary, and that a printhead according to the present invention may have any other suitable shape or size.

To permit ink supplies or printheads to be changed when necessary, ink supply 12 and printhead 14 may be removably connected to manifold 16. These parts may be removably connected to manifold 16 in any suitable manner. In the depicted embodiment, ink inlet 24 includes a cylindrical tower 26 configured to fit snugly within the inner diameter of a complementary acceptor 28 disposed on the underside of manifold 16. An ink conduit, the path of which is indicated with a dashed line at 30, extends through the manifold effectively from ink supply 12 to complementary acceptor 28 to deliver ink from ink supply 12 to ink inlet 24. As printhead 14 deposits ink onto a sheet of media, the pressure differential within casing 20 caused by the ejection of ink pulls a replacement volume of ink from manifold 16, which is then replenished by ink supply 12. If desired, a retaining mechanism (not shown) may be used to fasten printhead 14 to manifold 16 more securely.

No matter the type of connection used between cylindrical tower 26 and complementary acceptor 28, the connection presents a possible pathway for air movement in to or vapor movement out of the system. The existence of an air or vapor flow path may cause several possible problems. For example, air may contaminate the ink, or water and solvents may evaporate from the ink. Also, if an air leak exists at this connection, the ejection of ink from printhead 14 causes a negative gauge pressure within printhead casing 20, cylindrical tower 26 and ink conduit 30 that may cause air to be pulled into the printhead (rather than replacement ink) during printing.

Even if the seal doesn't have imperfections, air may still be able to enter the system through the seal when a new printhead is installed. For example, the seal between tower 26 and complementary acceptor 28 may be a wet seal that only seals while ink is present in the connection. In this situation, when a new printhead 14 is installed, tower 26 may not be completely filled with ink. Thus, the presence of air within the seal between the tower and complementary connector 28 may result in an imperfect seal between tower 26 and complementary connector 28, and thus allow air to be drawn into the printhead by the ejection of ink when printing is resumed.

Figure 3:
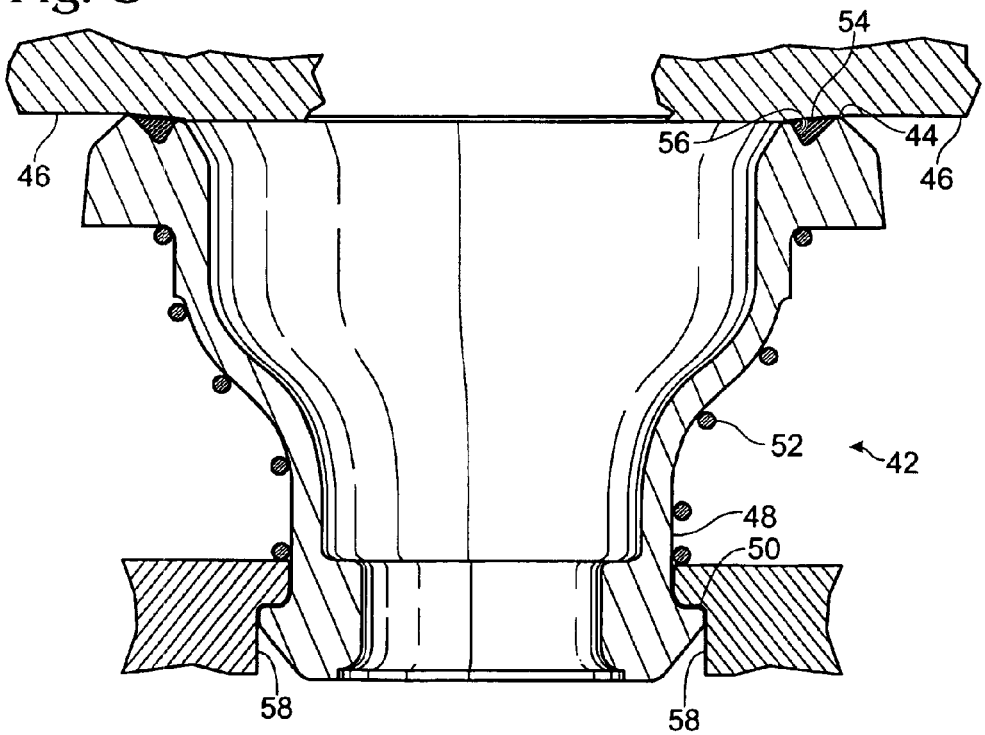
FIG. 3 is a cross-sectional view of a seal between a printhead and an ink manifold in accordance with an embodiment of the present invention.

To mitigate these problems, ink inlet 24 may include a redundant outer seal 40 to seal the connection of tower 26 and complementary connector 28 against vapor loss and air leakage. FIG. 2 shows the locations and general configuration of each outer seal 40, and FIG. 3 shows more structural detail of a single outer seal. The structure and operation of an outer seal is described below in terms of the seal between a printhead and a manifold. However, it will be appreciated that the description is equally applicable to seals between a manifold and an ink supply.

As best indicated in FIGS. 2 and 3, the outer seal is formed by the contact between manifold 16 and an extension 42 that extends upwardly from the top of printhead 14. In the depicted embodiment, extension 42 has a flared, generally conical shape, but it may have any other suitable shape if desired. Extension 42 is configured to form a contact seal with manifold 16. Thus, extension 42 has a sealing surface 44 disposed about its upper periphery. Sealing surface 44 is configured to form an unbroken contact with an opposing sealing surface 46 that is disposed on the underside of manifold 16 (FIG. 2 depicts printhead 14 prior to contact between sealing surface 44 and opposing sealing surface 46). Thus, when a new printhead is installed, if air is drawn into the connection between cylindrical tower 26 and complementary connector 28, this air will be drawn from the space between cylindrical tower 26 and extension 42, thus lowering the air pressure within the area defined by outer seal 40. This lowering of pressure will cause ink to be pulled from manifold 16, thus wetting and sealing the connection between tower 26 and complementary connector 28 before any additional air is drawn into the system.

Extension 42 may be coupled to printhead 16 in any desired manner. For example, extension 42 may be fixed to printhead 16 such that it does not move relative to casing 20. In the depicted embodiment, however, extension 42 is coupled to printhead 16 in such a manner that the extension has a limited range of vertical movement relative to casing 20. Extension 42 has a narrowed neck portion 48 that fits through a receiving orifice, shown in FIG. 3 at 58, on casing 20. A collar 50 disposed around the bottom of extension 42 retains the extension in the receiving orifice.

A coil spring 52 may be wound around extension 42 to bias sealing surface 44 against complimentary sealing surface 46 on the manifold. Thus, when printhead 14 is mounted to manifold 16, extension 42 is pushed slightly into casing 20. This causes coil spring 52 to push upwardly against extension 42 to increase the pressure of sealing surface 44 against opposing sealing surface 46. Although the depicted embodiment utilizes a coil spring to bias extension 42 upwardly, it will be appreciated that any other suitable biasing mechanism may be used without departing from the scope of the present invention.

Sealing surface 44 typically has a smooth, regular surface to form a tight seal with opposing sealing surface 46. However, debris such as dust or hair can contaminate sealing surface 44, and thus introduce imperfections in the seal that may permit air contamination or vapor loss to occur. Also, small voids may be formed in sealing surfaces 44 or 46 during manufacturing. To lessen the effects of contaminants, sealing surface 44 may be at least partially coated with a suitable sealant to prevent contaminants from opening up vapor leaks.

Suitable sealants for use on sealing surface 44 generally share a number of desirable physical properties. For example, a suitable sealant will have a very low permeability to air. Also, a suitable sealant should not cause the printhead to fail if the sealant contaminates the printhead or ink. Furthermore, a suitable sealant should have a high viscosity, typically on the order of approximately 100–1500 centipoises, so that it does not flow during storage, installation, etc.

Contamination of a printhead or the ink may occur in a number of ways. For example, if a user brushes sealing surface 44 against another printhead while installing printhead 14, sealant may be transferred to the other printhead, possibly clogging the ink ejection mechanisms. Also, if sealing surface 44 is brushed against tower 26 during installation, sealant may be transferred to the inside of tower 26, and thus contaminate the ink. Sealants that are soluble only in nonpolar solvents may thus not be suitable for use with an aqueous ink solution, as these sealants will not dissolve in the ink if they contaminate the ink.

To protect a printhead from damage caused by sealant contamination, a sealant with some degree of solubility in the ink solvent may be used. The sealant should be soluble enough in the ink solvent to dissolve and pass through the ink ejection mechanisms should contamination occur, but not so soluble that incidental contact with the ink solvent, or the ordinary presence of solvent vapor, will appreciably thin the sealant. If thinning occurs due to incidental contact with the solvent or the presence of vapor, the sealant may run, thus potentially opening air leaks in outer seal 40. Surfactant sealants are particularly preferred sealants, as many of these sealants have gas permeabilities on the order of grease sealants, yet are soluble in polar solvents. Surfactant sealants of a wide range of solubility in polar solvents are available. Thus, a selection of sealants will typically be available with a desired solubility.

One measure of the solubility of a surfactant is the hydro-lipo balance of the surfactant. The hydro-lipo balance is a unitless quantity with a value between 1 and 20, and signifies the relative quantities of hydrophilic and hydrophobic portions of a surfactant. Lower hydro-lipo balance values indicate a greater solubility in nonpolar solvents, and higher values represent a greater solubility in polar solvents. For an aqueous-based ink, a sealant with a hydro-lipo balance in the range of 10–20, and more typically in the range of 15–20, generally will have a desirable solubility in the ink.

Many different types of surfactant sealants may be used. Examples of suitable surfactants include nonionic or polymeric surfactants such as ethylene oxide/propylene oxide block copolymers, secondary alcohol ethoxylates, polyols, polyglycol ethers, polyethylene glycol and polypropylene glycol. Particularly suitable surfactants include ethylene oxide/propylene oxide block copolymers with molecular weights of approximately 2,000–10,000 and viscosities of approximately 225 centipoise. Higher molecular weight copolymers typically have higher viscosities than lower weight copolymers of the same class of materials, and thus have less of a tendency to flow.

Examples of suitable ethylene oxide/propylene oxide block copolymers include PLURONIC P65, PLURONIC 10R5 and PLURONIC L61 surfactants, available from BASF AG; MULTRANOL 4012, available from the Bayer Corporation; and Tergitol 15S3 and 15S5, available from Sigma-Aldrich. PLURONIC P65 is a particularly suitable surfactant, with a hydro-lipo balance of approximately 12–18, a viscosity of approximately 200 centipoise, a molecular weight of 3400, and a solubility of approximately 1 part surfactant to 10 parts ink by volume. An ink ejection orifice clogged with this surfactant will typically clear within approximately forty minutes if no cleaning processes are performed, and within 20 minutes or less is the printhead is wiped at the printer surface station.

The surfactant sealant can be applied either to sealing surface 44, or to opposing sealing surface 46. Typically the surfactant sealant is applied to sealing surface 44, as shown in FIG. 3. This allows the sealant to be applied to the printhead unit during production, rather than requiring a user to apply the sealant whenever a printhead or ink supply is changed.

Sealing surface 44 may include a recess 56 configured to hold the sealant, if desired. Placing sealant in recess 56 may help to prevent the sealant from being smeared or from flowing during storage. This also may help prevent accidental contamination of other printheads with sealant during printhead installation, as the sealant will have less exposed surface area when it is contained within recess 56. Additionally, sealing surface 44 may be configured to deform upon contact with opposing sealing surface 46 to increase the contact area between the sealing surfaces.

The disclosure set forth above encompasses multiple distinct inventions with independent utility. Although each of these inventions has been disclosed in its preferred form(s), the specific embodiments thereof as disclosed and illustrated herein are not to be considered in a limiting sense, because numerous variations are possible. The subject matter of the inventions includes all novel and nonobvious combinations and subcombinations of the various elements, features, functions, and/or properties disclosed herein. The following claims particularly point out certain combinations and subcombinations regarded as novel and nonobvious and directed to one of the inventions. These claims may refer to "an" element or "a first" element or the equivalent thereof; such claims should be understood to include incorporation of one or more such elements, neither requiring nor excluding two or more such elements. Inventions embodied in other combinations and subcombinations of features, functions, elements, and/or properties may be claimed through amendment of the present claims or through presentation of new claims in this or a related application. Such claims, whether directed to a different invention or to the same invention, and whether broader, narrower, equal, or different in scope to the original claims, also are regarded as included within the subject matter of the inventions of the present disclosure.

What is claimed is:

1. A component configured to be removably attached to a printer, the printer having an ink delivery system, the component comprising:

a casing;

an ink interconnect configured to fluidically couple the ink delivery system and the casing; and a sealing surface disposed on the ink interconnect, the sealing surface being configured to form a seal when in contact with an opposing sealing surface on the ink delivery system, wherein the sealing surface carries a surfactant sealant.

2. The component of claim 1, wherein the sealing surface defines a recess configured to retain the surfactant sealant.

3. The component of claim 1, the ink interconnect including an extension extending from the casing, the extension including a periphery, wherein the sealing surface is disposed on the periphery of the extension.

4. The component of claim 1, wherein the surfactant sealant is a polymeric surfactant.

5. The component of claim 4, wherein the polymeric surfactant is selected from the group consisting of ethylene oxide/propylene oxide block copolymers, polyols, polyglycol ethers, polyethylene glycol and polypropylene glycol.

6. The component of claim 1, wherein the seal is an outer seal, further comprising an inner seal surrounded by the outer seal, the inner seal connecting the ink interconnect to the ink delivery system.

7. The component of claim 6, wherein the inner seal is a wet seal, and wherein the outer seal prevents air from being drawn into the component while sufficient ink to wet the inner seal is drawn through the inner seal.

8. The component of claim 1, wherein the sealant solubility in ink from the ink delivery system is about 1 part sealant to 10 parts ink by volume.

9. The component of claim 1, wherein the sealant has a viscosity ranging from about 100 to about 1500 centipoise.

10. The component of claim 1, wherein the sealant is disposed between the sealing surface and the opposing sealing surface to block air passage between the opposed sealing surfaces.

11. A component configured to be removably attached to a printer, the print r having an ink delivery system, the component comprising:

a casing;

an ink interconnect configured to fluidically couple the ink delivery system and the casing; and a sealing surface disposed on the ink interconnect, the sealing surface being configured to form a seal when in contact with an opposing sealing surface on the ink delivery system, wherein the sealing surface carries a surfactant sealant, and wherein the surfactant has a hydro-lipo balance within a range of approximately 10–20.

12. The component of claim 11, wherein the surfactant has a hydro-lipo balance within a range of approximately 15–20.

13. A printhead configured to be removably attached to a printer, the printer having an ink delivery system, the printhead comprising:

a casing;

an ink inlet configured to accept ink from the ink delivery system into the casing;

an ink ejection mechanism configured to eject ink from the casing; and a sealing surface disposed on the ink inlet, the sealing surface being configured to form a seal when in contact with an opposing sealing surface on the ink delivery system, wherein the sealing surface carries a surfactant sealant.

14. The printhead of claim 13, wherein the sealing surface defines a recess configured to retain the surfactant sealant.

15. The printhead of claim 13, the ink inlet including an extension extending from the casing, the extension including a rim, wherein the sealing surface is disposed on the rim of the extension.

16. The printhead of claim 13, wherein the surfactant sealant is a polymeric surfactant.

17. The printhead of claim 16, wherein the polymeric surfactant is selected from the group consisting of ethylene oxide/propylene oxide block copolymers, polyols, polyglycol ethers, polyethylene glycol and polypropylene glycol.

18. The printhead of claim 13, wherein the seal is an outer seal, further comprising an inner seal surrounded by the outer seal, the inner seal connecting the ink inlet to the ink delivery system.

19. The printhead of claim 18, wherein the inner seal is a wet seal, and wherein the outer seal prevents air from being drawn into the printhead while sufficient ink to wet the inner seal is drawn through the inner seal.

20. The printhead of claim 13, wherein the sealant is sufficiently soluble in ink in the casing to dissolve and pass through the ink ejection mechanism.

21. The printhead of claim 20, wherein the solubility of the sealant in the ink as about 1 part sealant to 10 parts ink by volume.

22. The printhead of claim 13, wherein the sealant has a viscosity ranging from about 100 to about 1500 centipoise.

23. The printhead of claim 13, wherein the sealant is disposed between the sealing surface and the opposing sealing surface to block air passage between the opposed sealing surfaces.

24. A printhead configured to be removably attached to a printer, the printer having an ink delivery system, the printhead comprising:

a casing;

an ink inlet configured to accept ink from the ink delivery system into the casing;

an ink ejection mechanism configured to eject ink from the casing; and a sealing surface disposed on the ink inlet, the sealing surface being configured to form a seal when in contact with an opposing sealing surface on the ink delivery system, wherein the sealing surface carries a surfactant sealant, and wherein the surfactant has a hydro-lipo balance within a range of approximately 10–20.

25. The printhead of claim 24, wherein the surfactant has a hydro-lipo balance within a range of approximately 15–20.

26. A printer, comprising:

an ink supply;

a printhead;

an ink transfer structure extending between the ink supply and the printhead to accommodate the transfer of ink from the ink supply to the printhead; and a seal disposed between the ink supply and the printhead, the seal including two opposed sealing surfaces and a surfactant sealant disposed between the opposed sealing surfaces to block air passage between the opposed sealing surfaces.

27. The printer of claim 26, wherein one of the opposing sealing surfaces is disposed on the printhead, and wherein the other of the opposing sealing surfaces is disposed on the ink transfer structure.

28. The printer of claim 26, wherein at least one of the sealing surfaces includes a recess configured to accommodate receipt of the surfactant sealant.

29. The printer of claim 26, wherein the surfactant sealant is a nonionic surfactant.

30. The printer of claim 29, wherein the nonionic surfactant is selected from the group consisting of ethylene oxide/propylene oxide block copolymers, polyols, polyglycol ethers, polyethylene glycol and polypropylene glycol.

31. The printer of claim 26, wherein the surfactant sealant has a hydro-lipo balance within a range of approximately 10–20.

32. A method of protecting printer ink in a printer from vapor loss and air leakage, the printer including an ink supply, an ink delivery system, and a printhead, the ink delivery system providing fluid communication from the ink supply to the printhead, with at least one seal disposed between the printhead and the ink supply, the seal including a first sealing surface and an opposing second sealing surface, the method comprising:

applying a surfactant to at least one of the first sealing surface and the opposing second sealing surface; and contacting the first sealing surface to the opposing second sealing surface.

33. The method of claim 32, wherein at least one of the sealing surfaces is provided with a recess configured to hold a surfactant, and wherein applying the surfactant includes applying the surfactant to the recess.

34. The method of claim 32, wherein applying the surfactant includes applying a polymeric surfactant.

35. The printer of claim 34, wherein the polymeric surfactant includes a compound selected from the group consisting of ethylene oxide/propylene oxide block copolymers, polyols, polyglycol ethers, polyethylene glycol, polypropylene glycol, and mixtures thereof.

36. A method of protecting printer ink in a printer from vapor loss and air leakage, the printer including an ink supply, an ink delivery system, and a printhead, the ink delivery system providing fluid communication from the ink supply to the printhead, with at least one seal disposed between the printhead and the ink supply, the seal including a first sealing surface and an opposing second sealing surface, the method comprising:

applying a surfactant to at least one of the first sealing surface and the opposing second sealing surface wherein the surfactant has a hydro-lipo balance within a range of approximately 10–20; and contacting the first sealing surface to the opposing second sealing surface.

* * * * *

UNITED STATES PATENT AND TRADEMARK OFFICE

CERTIFICATE OF CORRECTION

PATENT NO. : 6,948,801 B2
APPLICATION NO. : 10/117648
DATED : September 27, 2005
INVENTOR(S) : Rehman et al.

It is certified that error appears in the above-identified patent and that said Letters Patent is hereby corrected as shown below:

Col. 7 (line 11), delete " print r" and insert therefor --printer--.

Signed and Sealed this

Fifth Day of September, 2006

JON W. DUDAS
*Director of the United States Patent and Trademark Office*